US005544760A

United States Patent [19]

Benn et al.

[11] Patent Number: 5,544,760

[45] Date of Patent: Aug. 13, 1996

[54] FLOTATION OF LEAD SULFIDES USING RAPESEED OIL

[76] Inventors: Freddy W. Benn; Marion Dattilo; William L. Cornell, all of Rolla Research Center, Bureau of Mines, Department of the Interior, 1300 N. Bishop, Rolla, Mo. 65401

[21] Appl. No.: 326,299

[22] Filed: Oct. 20, 1994

[51] Int. Cl.[6] ..... B03D 1/02; B03D 1/06

[52] U.S. Cl. ..... 209/166; 241/20

[58] Field of Search ..... 241/20, 24; 209/166, 209/167, 164

[56] References Cited

U.S. PATENT DOCUMENTS

| | | | |
|---|---|---|---|
| 1,067,485 | 7/1913 | Nutter . | |
| 2,065,053 | 12/1936 | Christmann . | |
| 2,120,217 | 6/1938 | Harris . | |
| 2,122,659 | 7/1938 | Ralston . | |
| 2,125,852 | 8/1938 | Ralston . | |
| 2,250,190 | 7/1941 | Christmann . | |
| 2,285,394 | 6/1942 | Coke . | |
| 2,331,722 | 10/1943 | Patek . | |
| 2,395,639 | 2/1946 | Monson . | |
| 2,611,485 | 9/1952 | Tveter . | |
| 2,713,599 | 7/1955 | Lorand . | |
| 2,776,749 | 1/1957 | Powell . | |
| 2,950,818 | 8/1960 | Moeller . | |
| 2,984,354 | 5/1961 | Carpenter . | |
| 3,037,627 | 6/1962 | Hazen . | |
| 3,072,256 | 1/1963 | Gotte . | |
| 3,595,390 | 7/1971 | Booth . | |
| 3,865,718 | 2/1975 | Tveter . | |
| 4,589,980 | 5/1986 | Keys | 209/166 |
| 5,223,147 | 6/1993 | Rosenstock et al. | 210/705 |
| 5,225,046 | 7/1993 | Borchardt et al. | 162/5 |
| 5,441,156 | 8/1995 | Fabry . | |

OTHER PUBLICATIONS

Chemical Abstracts 107:81479 "Thermal Differentiation Of Oils Used As Collectors In Floatation".

Chemical Abstracts 103:39267 "Chemical Problems With Rape Oil As Floatation Collector".

Jancik, V. "The Possibility Of Using Rape Fatty Acids For Technical Purposes", Birografika, 1964.

*Primary Examiner*—Thomas M. Lithgow

*Attorney, Agent, or Firm*—Richard S. Roberts

[57] ABSTRACT

An improved method for recovering lead sulfides from a mineral deposits. Pulverized mineral deposit material is mixed with water, agitated with pH adjustment from about 8 to about 10.5 to form a slurry. Rapeseed oil is added to the conditioned slurry to render the surface of the lead sulfide particles hydrophobic. After agitating and adding a frothing agent, air bubbles are injected into the resultant composition to cause hydrophobic lead sulfide particles to become attached to the air bubbles and to rise and form a froth fraction which is then separated and recovered. The process uses substantially non-toxic rapeseed oil as a hydrophilizing agent. The process is less environmentally damaging, less costly and more specific in separating lead sulfides from iron containing minerals which are normally present in ores together with the lead sulfides.

20 Claims, No Drawings

FLOTATION OF LEAD SULFIDES USING RAPESEED OIL

GOVERNMENT INTEREST

The invention described herein may be manufactured, used, and licensed by or for the U.S. Government for governmental purposes without the payment to us of any royalty thereon.

BACKGROUND OF THE INVENTION

This invention relates to lead mining, or more particularly to the processing of lead ores containing galena and associated sulfide minerals and for the remediation of lead waste tailings. The invention also finds use in the remediation of lead contaminated soils, sludges, and sediments.

At present there are hundreds of thousands of hazardous waste sites wherein lead is the most prevalent heavy metal contaminant. Many abandoned mine waste piles exist which contain residual lead deposits including sphalerite, chalcopyrite, and galena. There is therefore a great need for the clean processing of lead ores and for cleaning up of existing wastes to protect the environment. Many processing materials currently used in the lead processing industry are toxic. Therefore there is a great need for developing less toxic substances to be used in the processing of lead.

Many techniques for froth flotation of lead sulfide materials are well known in the art. Froth floatation renders the surface of the mineral to be collected hydrophobic and hence floatable. Previously known or used methods of galena flotation employ thiol collectors to render the galena surfaces hydrophobic. These thiol collectors include xanthates, mercaptans, thiocarbamates, trithiocarbonates, dithiophosphates, diphenyl thiourea, and mercaptobenzothiazole. All of these materials and their derivatives are highly toxic to animals, plants, and humans.

This invention substitutes rapeseed oil for the aforesaid thiol collectors. Rapeseed oil, also known commercially as Canola oil, is approximately 10 times less toxic than the thiol collectors and is considered essentially nontoxic to humans. Rapeseed oil is so nontoxic that it is listed as a food additive by the U.S. Food and Drug Administration.

A further problem in the art is that lead sulfides are normally present in ores together with iron containing minerals. Prior art froth floatation techniques are insufficiently selective to discriminate between lead sulfides and iron containing minerals. This invention provides an improved method of processing lead sulfide minerals using froth flotation which has a high selectivity against the iron minerals normally present in sulfide deposits.

Hence, the important advantages of this invention over the prior art are reduced toxicity and high specificity against the iron minerals present in the feed. The invention can also be used by lead mineral processors where there is an extreme concern for the environment and strict discharge limits for the processing plants.

SUMMARY OF THE INVENTION

The invention provides a method for recovering lead sulfides from a mineral deposit material containing lead sulfides which comprises:

(a) pulverizing the mineral deposit material to a particle size of from about 35 to about 150 microns;

(b) mixing the pulverized the mineral deposit particles with water to produce a mixture having from about 5 to about 50 percent solids by weight;

(c) agitating the mixture and adjusting its pH to a range of from about pH 8 to about 10.5 to produce a conditioned slurry;

(d) adding a sufficient amount of rapeseed oil to the conditioned slurry to render the surface of the lead sulfide particles hydrophobic;

(e) agitating the resultant slurry under conditions and for a time sufficient to obtain a homogeneous mixture;

(f) adding a frothing agent to the homogenous mixture in an amount sufficient to cause frothing of the homogenous mixture upon injection of air;

(g) injecting air bubbles into the resultant composition in an amount and under conditions sufficient to cause the hydrophobic lead sulfide particles to become attached to the air bubbles and cause the resultant air bubbles with attached lead sulfide particles to rise and form a froth fraction; and (h) separating the froth fraction and recovering lead sulfide.

The process is less toxic and more highly specific against iron minerals than other known lead sulfide recovery methods. These and other objects, features, and details of the invention will become apparent in light of the ensuing detailed disclosure.

DETAILED DESCRIPTION OF THE PREFERRED EMBODIMENT

The preferred embodiment will now be described with reference to the separation of galena, although other lead sulfides can be similarly processed. Particles of galena or other lead sulfide containing ores, whether from a primary or secondary lead ore or from a lead mill tailings product, are liberated from the host rock and/or gangue minerals. Typically the materials are pulverized to a particle size ranges from about 35 to about 150 microns. The mixture is diluted with water to form a pulp mixture containing from about 5 to about 50 percent solids by weight. This pulp mixture is agitated, typically at higher than 1,200 rpm with an appropriate slurry agitation system. The resulting pulp pH is adjusted to a pH of from about 8 to about 10.5. This may be done with one or more bases such as sodium carbonate or sodium hydroxide in an amount of from about 0.5 to about 2.5 kg/mt of feed to achieve the desired pH and form a conditioned slurry. Rapeseed oil is then added to the conditioned slurry in an amount of from about 0.24 to about 1.0 kg/mt of feed. Without being confined to a particular theory, it is believed that the fatty acid components of the rapeseed oil attach to the galena surfaces by chemically bonding with the surface of the galena and possibly with associated bonding from the double bonds of the unsaturated fatty acids. The primary fatty acid constituents of rapeseed oil are, in grams per 100 grams of total fatty acids, erucic 50, oleic 32, linoleic 15, linolenic 1 and palmitic 1.

The resulting slurry is agitated for several minutes, typically from about 3 to about 15 minutes. An appropriate frothing agent, typically a polypropylene glycol, is added at a dosage of from about 0.04 to about 0.15 kg/mt of feed and allowed to condition for several minutes, preferably from about 1 to about 3 minutes. The resulting pulp is injected with air, preferably at a rate of from about 6 to about 10 L/min, and the galena particles with the attached rapeseed oil constituents are attracted to the air bubbles. The air bubbles rise to the top of the slurry and the resulting froth fraction is removed by mechanical scraping. The froth fraction is found to contain from about 80 to about 95 percent of the original galena particles in only about 10 to about 15 percent of the original weight. The galena froth fraction is thereby upgraded by 100 to 1,000 percent relative to the initial feed.

Principal advantages of this invention over the prior art are reduced cost, reduced toxicity and a high degree of specificity against the iron minerals present in the feed sample. The rapeseed oil has low or minimal toxicity and is approximately 8 to 350 times less toxic than previously used flotation chemicals for the flotation of galena. Most prior art galena flotation collectors have an LD50 dosage (Lethal Dosage to kill 50 pct of the test subjects, in milligrams per kilogram of body weight) of less than 4,000 mg/kg, with some as low as 500 mg/kg. Rapeseed oil has no known toxicity, but some constituents are on the order of 32,000 to 70,000 mg/kg for the LD50.

Rapeseed oil costs approximately one-eighth to one-third the cost of xanthates and other traditional galena flotation chemicals. Selectivity against iron mineral flotation is another advantage of this invention. Rapeseed oil, when used in the above described process, tends to produce a galena concentrate lower in iron minerals such as pyrite and marcasite, which are normally associated with galena, than the previously used flotation chemicals. The iron rejection is on the order of about 85 to about 95 percent, whereas the previous flotation chemicals reject only from about 50 to about 75 percent of the available iron minerals.

EXAMPLE 1

Laboratory scale equipment was used in the following testing procedures. A sample of galena tailings was milled to liberation (particle size <150 micrometers) with a rod mill. The length of the rod mill was 22.23 cm. and the outside diameter was 21.6 cm. The mill was charged with six 1.27 cm diameter rods, seven 1.59 cm diameter rods, and eight 2.54 cm diameter rods. The milling procedure consisted of a two-stage grind of the tailings with the undersize particles (<150 micrometers) removed after the first stage. This ensured fresh mineral surfaces for subsequent flotation testing. The feed for each test was 500 g and was milled at 50 wt % solids. The oversized particles (>150 micrometers) remaining after the first stage was approximately 40 to 50% of the original weight and was reground at 50 wt % solids. The two stage milling procedure reduced the amount of fines generated. The normal grinding times were 10 minutes for the first stage and 5 minutes for the second stage. In some cases the flotation reagents or some of the reagents were added directly to the rod mill to give a more intimate contacting period. The ground pulp was then transferred to a flotation cell. The flotation procedure consisted of pulping the feed from 5 to 20% solids, agitation at 1300 rpm, addition of appropriate additive, pH adjustment (if needed), addition of collector, addition of frother, and introduction of air at 6.2 L/min. The normal conditioning time was 3 minutes/addition, with a 15 minute conditioning time. The normal flotation time was 5 minutes or until no solids were observed in the froth.

RESULTS

Flotation without a traditional sulfide collector (collectorless) was initially tested using previously developed optimum pH and modifier additions: sodium sulfides, a pulp pH of 9.5, and a frother (in this example a mixture of hydrocarbon oil and $C_4$ to $C_7$ alcohols). The reagent dosages were sodium sulfide at 0.5 kg/mt, a pulp pH of 9.5, and the frother at 0.05 kg/mt. This reagent composition recovered 88% of the Pb at a grade of 18% Pb, thus lowering the tailings fraction to 800 ppm Pb (0.08% Pb)

FLOATATION

The rapeseed oil was tested as the collector with other prior used flotation additives. Since previous research had shown the necessity of sodium sulfide for the galena flotation, the initial testing included it. It has been heretofore believed that sodium sulfide was necessary to activate tarnished galena surfaces. When the sodium sulfide was eliminated, Pb recovery dropped from about 84% to about 51%. In an effort to reduce the toxicity of the reagent composition even further, the combination of sodium carbonate and sodium hydroxide were successfully substituted. This indicated that the function of the sodium sulfide is for pH adjustment as opposed to being used to activate the tarnished galena. When the sodium carbonate and sodium hydroxide were added in place of the sodium sulfide, while using the rapeseed oil, Pb recovery increased to 89%, with a resulting increase in the Cu and Zn recovery. The concentrate grade was 5.4% Pb. The remaining tailings fraction contained >91% of the original weight with a Pb grade of 620 ppm (0.062%). The reagent composition with dosages, is shown Table 1.

TABLE 1

REAGENT COMPOSITION EMPLOYING RAPESEED OIL

| Reagent | kg/mt | Pulp pH | Conditioning Time (min.) |
|---|---|---|---|
| $Na_2CO_3$ | 1.5 | 9.2 | 5 |
| NaOH | 0.24 | 10.2 | 2 |
| Rapeseed | 0.24 | 10.2 | 15 |
| Polypropylene glycol frother | 0.08 | 10.2 | 3 |

| The metal recovery values were: | | | | |
|---|---|---|---|---|
| Weight % | Copper | Iron | Lead | Zinc |
| 8.85 | 61.5 | 7.8 | 89.0 | 52.4 |

A comparison of single stage flotation using rapeseed oil to prior art single collector, single stage flotation materials is shown in Table 2.

TABLE 2

SINGLE COLLECTOR COMPARISON FROM SINGLE-STAGE FLOTATION TESTS

| | Metal Recovery (%) | | | |
|---|---|---|---|---|
| Collector Type | Pb | Cu | Zn | Fe |
| Xanthate | 65 | 19 | 15 | 6 |
| Dithiophosphate | 65 | 33 | 26 | 4 |
| Mercaptan | 14 | 5 | 6 | 2 |
| Mercaptobenzothiazole | 68 | 51 | 44 | 5 |
| Rapeseed Oil | 89 | 61 | 52 | 8 |

These data show that use of rapeseed oil in froth flotation improves the recovery of Pb and other heavy metals from lead mill tailings. Froth flotation lowered the amount of Pb remaining in the tailings to <620 ppm using rapeseed oil as the galena collector. The rapeseed oil improves recoveries of Pb, Cu, and Zn while maintaining selectivity against the floatation of iron in the single-stage flotations.

The above described process can be used for primary lead ores and lead mill tailings as well as for the processing of secondary lead ores. The process may similarly be used to recover sphalerite and chalcopyrite from both a primary lead ore and from the lead mill tailings.

What is claimed is:

1. A method for recovering lead sulfides from a mineral deposit material containing lead sulfides which comprises:

(a) pulverizing the mineral deposit material to a particle size of from about 35 to about 150 microns;

(b) mixing the pulverized mineral deposit particles with water to produce a mixture having from about 5 to about 50 percent solids by weight;

(c) agitating the mixture and adjusting its pH to a range of from about pH 8 to about 10.5 to produce a conditioned slurry;

(d) adding a sufficient amount of rapeseed oil to the conditioned slurry to render the surface of the lead sulfide particles hydrophobic;

(e) agitating the resultant slurry from step (d) under conditions and for a time sufficient to obtain a homogeneous mixture;

(f) adding a frothing agent to the homogenous mixture in an amount sufficient to cause frothing of the homogenous mixture upon injection of air;

(g) injecting air bubbles into the resultant composition from step (f) in an amount and under conditions sufficient to cause the hydrophobic lead sulfide particles to become attached to the air bubbles and cause the resultant air bubbles with attached lead sulfide particles to rise and form a froth fraction; and (h) separating the froth fraction and recovering lead sulfide.

2. The method of claim 1 wherein the mineral deposit material comprises one or more sulfides selected from the group consisting of sphalerite, and chalcopyrite.

3. The method of claim 1 wherein the agitation of step (c) is conducted with slurry agitation means at 1,200 rpm or more.

4. The method of claim 1 wherein the pH adjustment is conducted with at least one base.

5. The method of claim 1 wherein the pH adjustment is conducted with at least one base in an amount of from about 0.5 to about 2.5 kg/mt of the mixture.

6. The method of claim 4 wherein the pH adjustment is conducted with sodium carbonate, sodium hydroxide or a blend thereof.

7. The method of claim 5 wherein the pH adjustment is conducted with sodium carbonate, sodium hydroxide or a blend thereof.

8. The method of claim 1 wherein the rapeseed oil is added to the conditioned slurry in an amount of from about 0.24 to about 1.0 kg/mt of conditioned slurry.

9. The method of claim 1 wherein the agitation of step (e) is conducted from about 3 to about 15 minutes.

10. The method of claim 1 wherein the frothing agent is polypropylene glycol.

11. The method of claim 1 wherein the frothing agent is added in an amount of from about 0.04 to about 0.15 kg/mt of the homogenous mixture.

12. The method of claim 1 wherein the frothing agent conditions the homogenous mixture for from about 1 to about 3 minutes.

13. The method of claim 1 wherein the air is injected at a rate of from about 6 to about 10 L/min.

14. The method of claim 1 wherein the froth fraction is removed by mechanical scraping.

15. The method of claim 1 wherein the froth fraction contains from about 80 to about 95 percent of the lead sulfides of the mineral deposit material.

16. A method for recovering galena from a mineral deposit material containing galena which comprises:

(a) pulverizing the mineral deposit material to a particle size of from about 35 to about 150 microns;

(b) mixing the pulverized mineral deposit particles with water to produce a mixture having from about 5 to about 50 percent solids by weight;

(c) agitating the mixture and adjusting its pH to a range of from about pH 8 to about 10.5 to produce a conditioned slurry;

(d) adding a sufficient amount of rapeseed oil to the conditioned slurry to render the surface of the galena particles hydrophobic;

(e) agitating the resultant slurry from step (d) under conditions and for a time sufficient to obtain a homogeneous mixture;

(f) adding a frothing agent to the homogenous mixture in an amount sufficient to cause frothing of the homogenous mixture upon injection of air;

(g) injecting air bubbles into the resultant composition from step (f) in an amount and under conditions sufficient to cause the hydrophobic galena particles to become attached to the air bubbles and cause the resultant air bubbles with attached galena particles to rise and form a froth fraction; and (h) separating the froth fraction and recovering galena.

17. The method of claim 16 wherein the pH adjustment is conducted with sodium carbonate, sodium hydroxide or a blend thereof; and wherein the frothing agent is polypropylene glycol.

18. The method of claim 17 wherein the agitation of step (c) is conducted with slurry agitation means at 1,200 rpm or more; and wherein the pH adjustment is conducted with sodium carbonate, sodium hydroxide or a blend thereof in an amount of from about 0.5 to about 2.5 kg/mt of the mixture; and wherein the rapeseed oil is added to the conditioned slurry in an amount of from about 0.24 to about 1.0 kg/mt of conditioned slurry; and wherein the agitation of step (e) is conducted from about 3 to about 15 minutes; and wherein the frothing agent is added in an amount of from about 0.04 to about 0.15 kg/mt of the homogenous mixture and wherein the frothing agent conditions the homogenous mixture for from about 1 to about 3 minutes; and wherein the air is injected at a rate of from about 6 to about 10 L/min; and wherein the froth fraction is removed by mechanical scraping; and wherein the froth fraction contains from about 80 to about 95 percent of the lead sulfides of the mineral deposit material.

19. The method of claim 1 wherein from about 85 percent to about 95 percent of iron minerals in the mineral deposit are rejected from the lead sulfide in the froth fraction.

20. The method of claim 19 wherein the iron minerals are pyrite or marcasite.

* * * * *